US010779562B2

(12) United States Patent
Gielniewski

(10) Patent No.: US 10,779,562 B2
(45) Date of Patent: Sep. 22, 2020

(54) METHOD OF EMPTYING TRAYS FILLED WITH ROD-SHAPED ARTICLES OF THE TOBACCO INDUSTRY

(71) Applicant: International Tobacco Machinery Poland Sp. z o. o., Radom (PL)

(72) Inventor: Adam Gielniewski, Radom (PL)

(73) Assignee: International Tobacco Machinery Poland Sp. z o. o., Radom (PL)

( * ) Notice: Subject to any disclaimer, the term of this patent is extended or adjusted under 35 U.S.C. 154(b) by 0 days.

(21) Appl. No.: 15/920,217

(22) Filed: Mar. 13, 2018

(65) Prior Publication Data

US 2018/0271141 A1 Sep. 27, 2018

(30) Foreign Application Priority Data

Mar. 27, 2017 (EP) ..... 17163139

(51) Int. Cl.
*B65B 19/04* (2006.01)
*A24C 5/356* (2006.01)
*A24C 5/358* (2006.01)

(52) U.S. Cl.
CPC ..... *A24C 5/356* (2013.01); *A24C 5/358* (2013.01); *B65B 19/04* (2013.01)

(58) Field of Classification Search
CPC ..... A24C 5/356; B65B 19/04
See application file for complete search history.

(56) References Cited

U.S. PATENT DOCUMENTS 4,303,366 A * 12/1981 Hinchcliffe ..... A24C 5/356 414/419
4,365,703 A * 12/1982 Hinchcliffe ..... A24C 5/352 198/347.1

(Continued)

FOREIGN PATENT DOCUMENTS

DE 102007022845 A1 11/2008
EP 1020126 7/2000

(Continued)

OTHER PUBLICATIONS

European Search Report for EP 17 16 3139, completed Oct. 16, 2017.

*Primary Examiner* — Jonathan Snelting
(74) *Attorney, Agent, or Firm* — Oppedahl Patent Law Firm LLC

(57) ABSTRACT

A method of emptying trays filled with rod-shaped articles produced in the tobacco industry, which consist of the following stages: the trays designated for emptying are conveyed to the input area of a hopper containing adjacent channels separated by dividers; the rod-shaped articles are transferred from the tray to the channels of the hopper using support plates; the channels of the hopper are filled with the rod-shaped articles; the support plates are retracted from the channels of the hopper; the channels of the hopper are successively emptied into a chute adapted to move between channel outlets of the hopper; finally, the rod-shaped articles are transferred from the channels of the hopper and through the chute to the discharge conveyor moving towards the receiving device. The method is further characterized in that during emptying at least one channel (7) of the hopper (2), the hopper (2) moves linearly in the direction (S2) opposite to the direction (T) in which the rod-shaped articles are transported by the discharge conveyor (19); and after the channel (7) has been completely emptied, the hopper (2)

(Continued)

Figure 1:
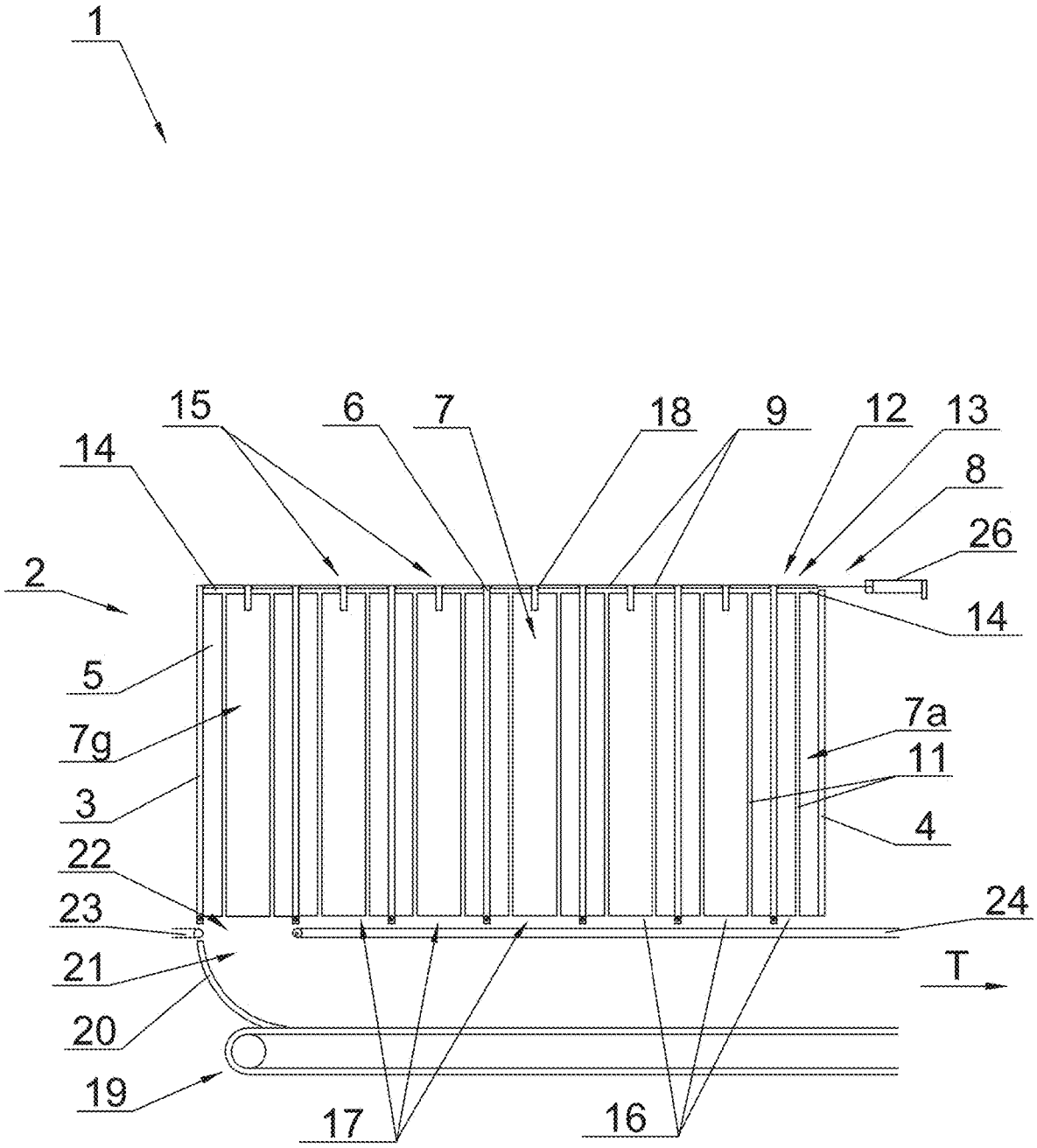

moves in the direction (S1) concurrent with the direction (T) in which the rod-shaped articles are transported by the discharge conveyor (19), until it achieves a position in which the outlet of the next channel filled with rod-shaped articles is aligned with the inlet (21) of the chute (20), whereas the hopper (2) moves at a variable velocity when moving in the direction (S1) concurrent with the direction (T) in which the rod-shaped articles are transported by the conveyor.

9 Claims, 15 Drawing Sheets

(56) References Cited

U.S. PATENT DOCUMENTS

| | | | | |
|---|---|---|---|---|
| 8,100,621 | B2 * | 1/2012 | Budny | A24C 5/356<br>414/403 |
| 2008/0213072 | A1 | 9/2008 | Bundy | |
| 2014/0158252 | A1 | 6/2014 | Owczarek | |

FOREIGN PATENT DOCUMENTS

| | | | |
|---|---|---|---|
| WO | 2008020775 | | 2/2008 |
| WO | WO2009145651 | A1 | 12/2009 |

* cited by examiner

Vs=0 Vg=0 Vt>0

METHOD OF EMPTYING TRAYS FILLED WITH ROD-SHAPED ARTICLES OF THE TOBACCO INDUSTRY

The subject of the invention is a method of emptying trays filled with rod-shaped articles of the tobacco industry.

Tobacco factories produce a variety of smoking articles. Both finished and semi-finished products fabricated at different stages of production can generally be described as rod-shaped articles, which can be transported on conveyors or in trays. Commonly used in the tobacco industry are plastic trays, which are used for all types of rod-shaped articles, including cigarettes, cigarillos, cigars, and filter rods. The plastic trays are in the shape of a cuboid without two walls, i.e. they have four walls. The plastic trays are rigid and serve to temporarily store and transport rod-shaped articles in tobacco factories. The rod-shaped articles stored in the trays are emptied into the mass flow supplied to machines that perform technical operations in order to fabricate the smoking articles.

U.S. Pat. No. 8,100,621 discloses a device and method for the consecutive emptying of trays filled with rod-shaped articles, the device comprising the means for conveying rod-shaped articles incoming from trays, as well as a chute connecting the outlet of articles with the means of transport, such that a channel is created, through which the stream of rod-shaped articles can be moved towards the receiving device.

European patent No. EP1020126 describes a method and device for transporting cigarettes, in which cigarettes are transported using trays from a processing machine to a hopper, where they are unloaded, and then transported using discharge conveyors to a packer hopper. According to the invention, the hopper unit is divided by dividers into several adjacent channels. Each of the channels has a support element, which moves together with the cigarettes from top to bottom of the hopper, where the dividers are tear-shaped and built like a comb with its protruding ribs inserted into the notches of the supporting elements in the form of a flat comb. The vertical side wall of the hopper on the side of the packer is moveable, and moves together with the conveyor that conveys the cigarettes towards the packer hopper. The length of the dividers is shorter than the height of the hopper, where the shortest divider is that closest to the moveable side wall, and the length of the subsequent dividers gradually increases. The end of the longest divider is at a significant distance from the discharge conveyor. A layer of cigarettes is thus transported to the hopper, and the height of the layer corresponds to that of the moveable side wall. The height of the layer is maintained by the moving side wall until it reaches the hopper. All known methods and devices for unloading trays are characterized by the common principle that the discharge of individual channels to the discharge conveyor is gravitational due to the removal of individual elements supporting the cigarettes from the bottom in individual channels or groups of channels. This involves the risk of jamming, or deformation of the rod-shaped articles.

The subject of the invention is a method of emptying trays filled with rod-shaped articles of the tobacco industry, which consists of the following steps: trays designated for emptying are conveyed to an input area of a hopper containing adjacent channels separated by dividers; the rod-shaped articles are transferred from the trays to the channels of the hopper using support plates; the channels of the hopper are filled with the rod-shaped articles; the support plates are retracted from the channels of the hopper; the channels of the hopper are successively emptied into a chute adapted to move between the outlets of the channels of the hopper; finally, the rod-shaped articles are transferred from the channels of the hopper and through the chute onto the discharge conveyor moving towards the receiving device. The method is further characterized in that during emptying at least one channel of the hopper, the hopper moves linearly in the direction opposite to that in which the rod-shaped articles are transported by the discharge conveyor; and after the channel has been completely emptied, the hopper moves in the direction concurrent with the direction in which the rod-shaped articles are transported by the discharge conveyor, until the outlet of the next channel filled with rod-shaped articles is aligned with the inlet of the chute, whereas the hopper moves at a variable velocity when moving in the direction concurrent with that in which the rod-shaped articles are transported by the discharge conveyor.

Furthermore, the method is characterized in that when the hopper is moving in the direction concurrent with the direction in which the rod-shaped articles are transported by the discharge conveyor, the velocity of movement of the hopper reaches zero.

Furthermore, the method is characterized in that when the hopper is moving in the direction concurrent with the direction in which the rod-shaped articles are transported by the discharge conveyor, the velocity of movement of the hopper decreases until it achieves a position in which the outlet of the next channel filled with rod-shaped articles is aligned with the inlet of the chute.

Furthermore, the method is characterized in that when the hopper is moving in the direction concurrent with the direction in which the rod-shaped articles are transported by the discharge conveyor, the hopper moves at a first velocity, and after receiving a signal from an accumulation sensor that rod-shaped articles have accumulated near the inlet of the chute, the hopper moves at a second velocity, whereas the second velocity is lower than the first velocity, until it achieves a position in which the outlet of the next channel filled with rod-shaped articles is aligned with the inlet of the chute.

Furthermore, the method is characterized in that when the hopper is moving in the direction concurrent with the direction in which the rod-shaped articles are transported by the discharge conveyor, the hopper moves at first velocity, and after receiving a signal from the accumulation sensor indicating lack of accumulated rod-shaped articles near the inlet of the chute, the hopper moves at a second velocity, where the second velocity is higher than the first velocity, until it achieves a position in which the outlet of the next channel filled with rod-shaped articles is aligned with the inlet of the chute.

Furthermore, the method is characterized in that the direction of movement of the hopper changes, after receiving a signal from the channel fill sensor indicating a change in the extent to which the hopper is filled with rod-shaped articles, from the direction opposite to that in which the rod-shaped articles are transported by the discharge conveyor, to the direction concurrent with the direction in which the rod-shaped articles are transported by the discharge conveyor.

Furthermore, the method is characterized in that the direction of movement of the hopper changes, after receiving a signal from the channel fill sensor indicating that the next channel of the hopper is aligned with the inlet of the chute, from the direction concurrent with the direction in which the rod-shaped articles are transported by the discharge conveyor, to the direction opposite to the direction in which the rod-shaped articles are transported by the discharge conveyor.

Furthermore, the method is characterized in that the chute, in order to empty the rod-shaped articles from at least one channel of the hopper, moves linearly in the direction opposite to the direction in which the rod-shaped articles are transported by the discharge conveyor, until all the rod-shaped articles have been emptied from the channel.

Furthermore, the method is characterized in that the chute, after receiving a signal from the channel fill sensor indicating that the rod-shaped articles have been emptied from the channel of the hopper, starts to move linearly in the direction concurrent with the direction in which the rod-shaped articles are transported by the discharge conveyor, until the next channel of the hopper is aligned with the inlet of the chute.

Furthermore, the method is characterized in that the chute moves linearly in the direction opposite to the direction in which the rod-shaped articles are transported by the discharge conveyor at an instantaneous velocity equal to the velocity of movement of the hopper.

Furthermore, the method is characterized in that the chute moves in the direction concurrent with the direction in which the rod-shaped articles are transported by the discharge conveyor at an instantaneous velocity lower than the velocity of movement of the hopper.

Furthermore, the method is characterized in that the chute moves in the direction concurrent with the direction in which the rod-shaped articles are transported by the discharge conveyor with a velocity equal to the velocity at which the rod-shaped articles are transported by the discharge conveyor.

The object of the invention was shown in detail in preferred embodiment in a drawing in which:

FIG. 1 presents a front view of a station for emptying a filled tray before loading a filled tray.

Figure 2:
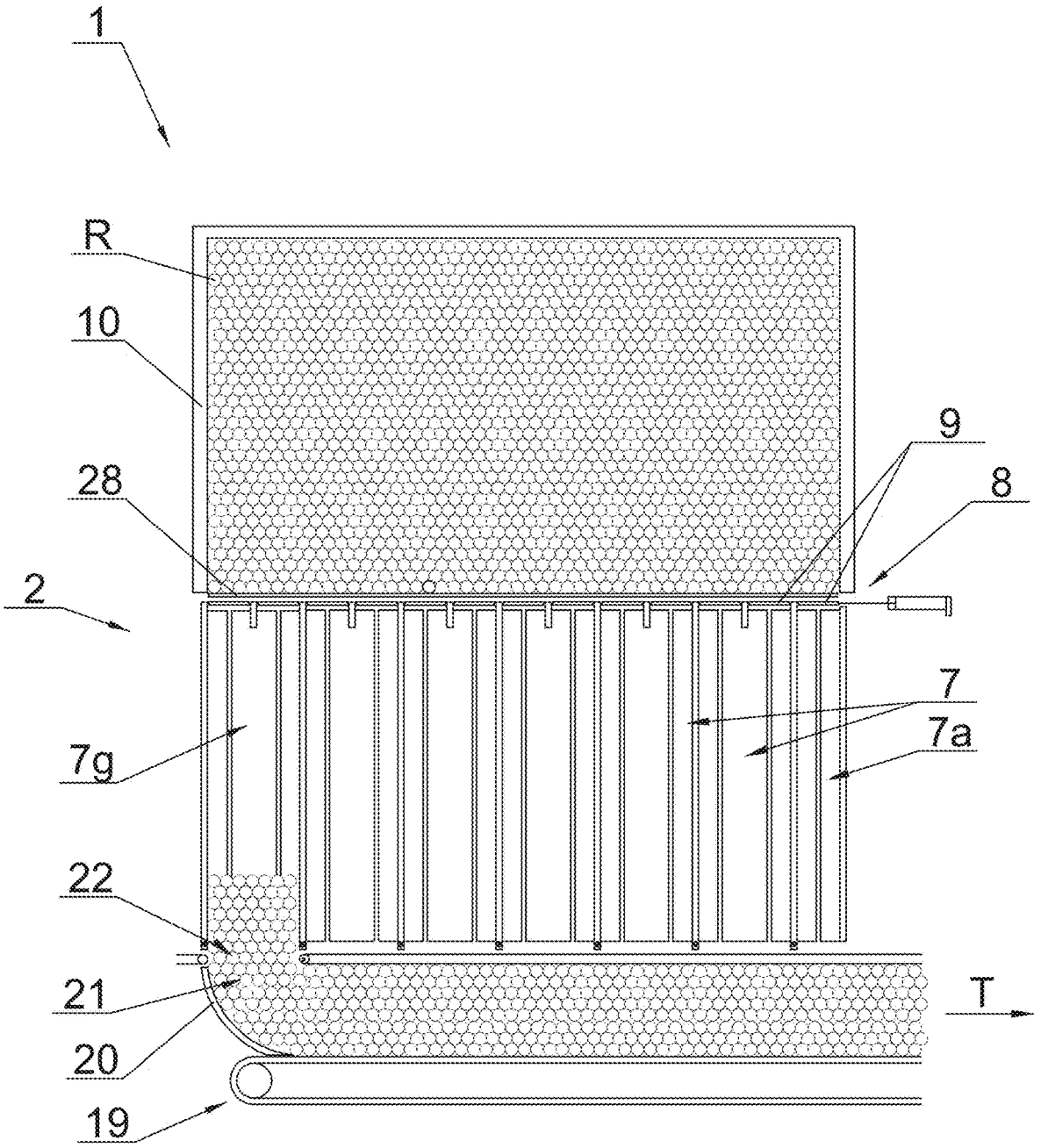

FIG. 2 presents a front view of the station for emptying a filled tray after loading the filled tray.

Figure 3:
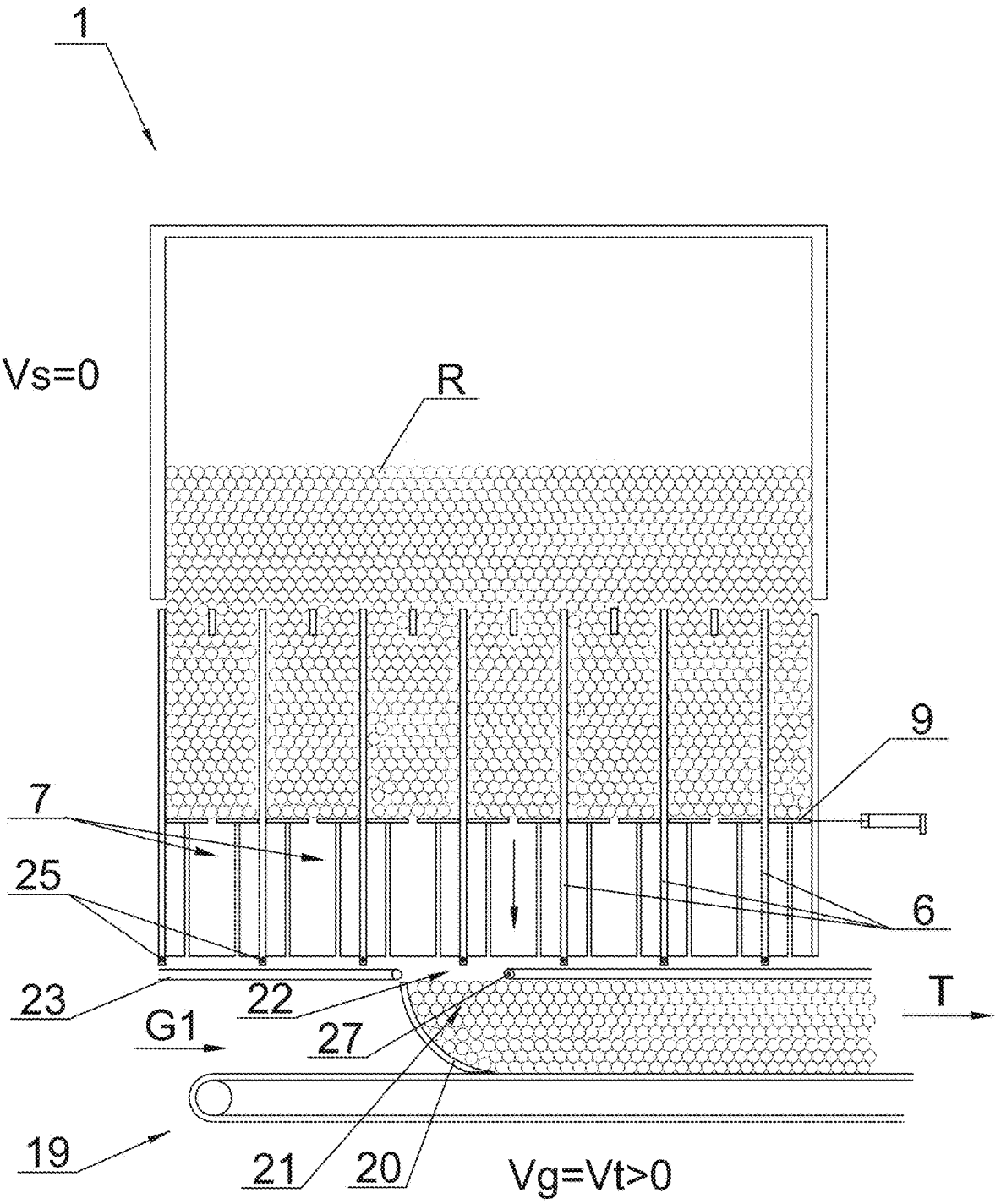

FIG. 3 presents the process of transferring rod-shaped articles from trays to channels of a hopper.

Figure 4:
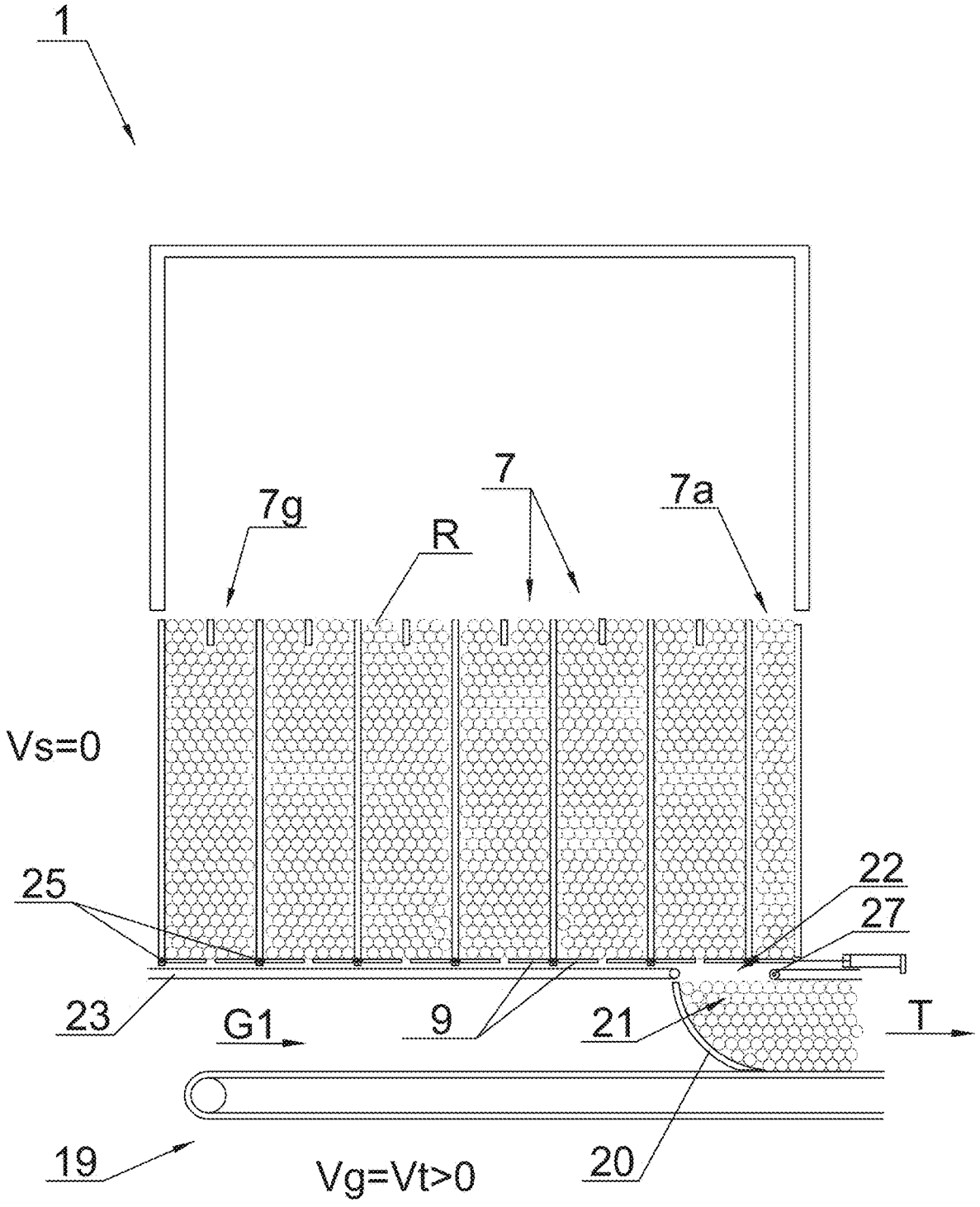

FIG. 4 presents a front view of the station for emptying a filled tray after rod-shaped articles have been transferred to the channels of the hopper, with the movement of a chute back to the starting position.

Figure 5:
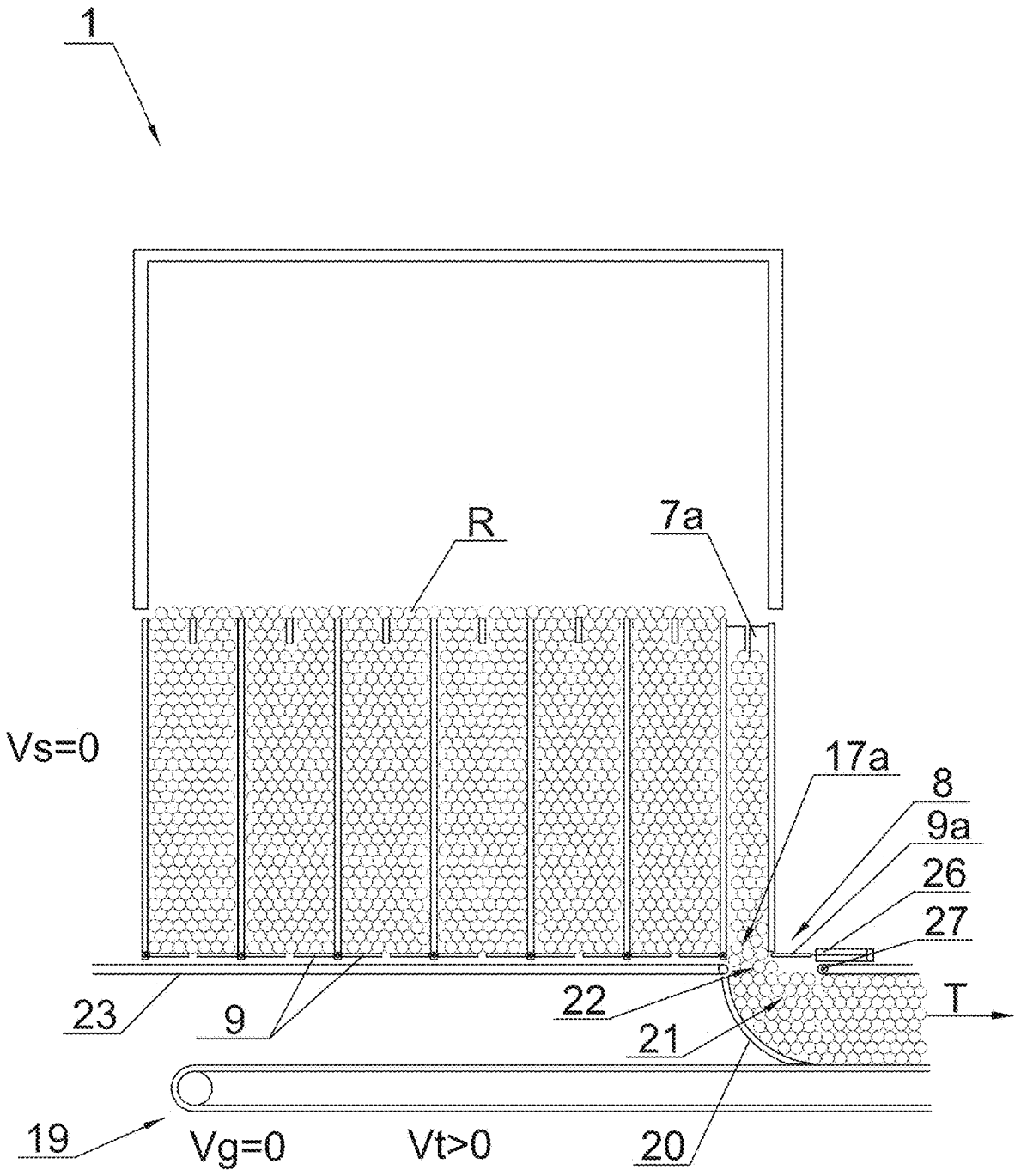

FIG. 5 presents a front view of the station for emptying a filled tray at the moment when the outer channel of the hopper is being emptied.

Figure 6:
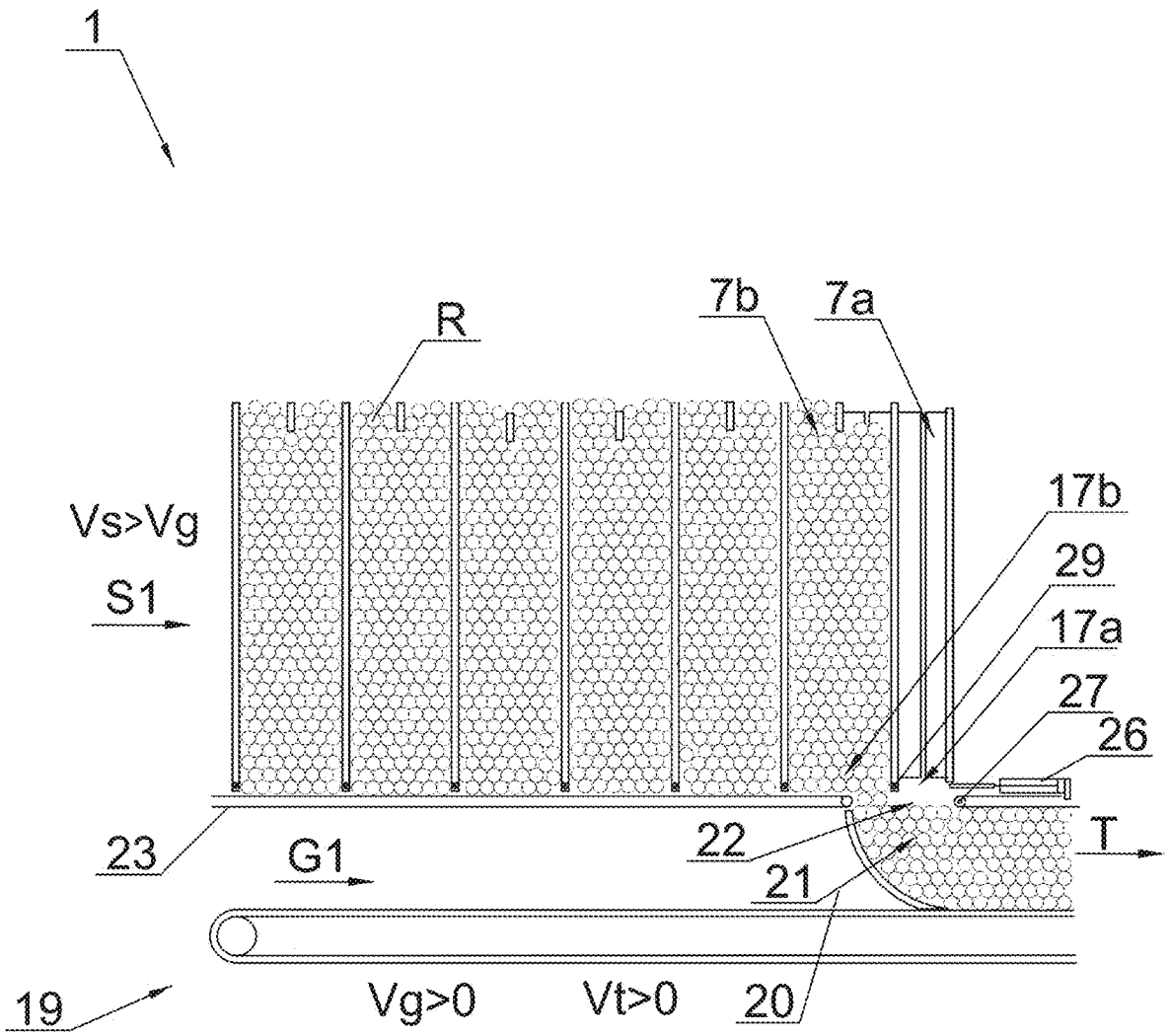

FIG. 6 presents a front view of the station for emptying the filled tray at the moment when the outer channel of the hopper is being emptied, and the hopper is moving to adjust to the position of the chute.

Figure 7:
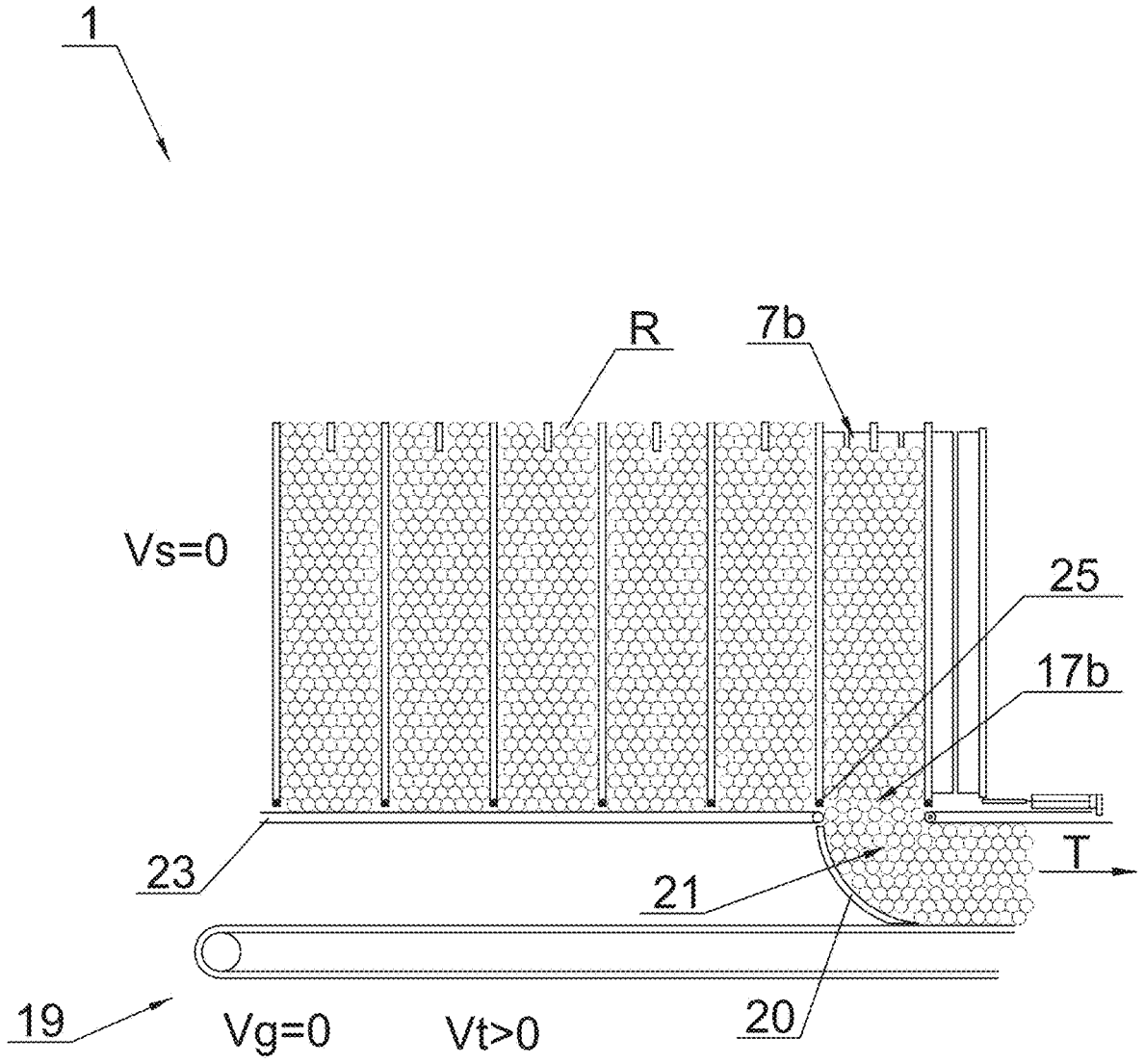

FIG. 7 presents a front view of the station for emptying the filled tray at the moment when the next filled channel of the hopper is aligned with the entrance to the chute.

Figure 8:
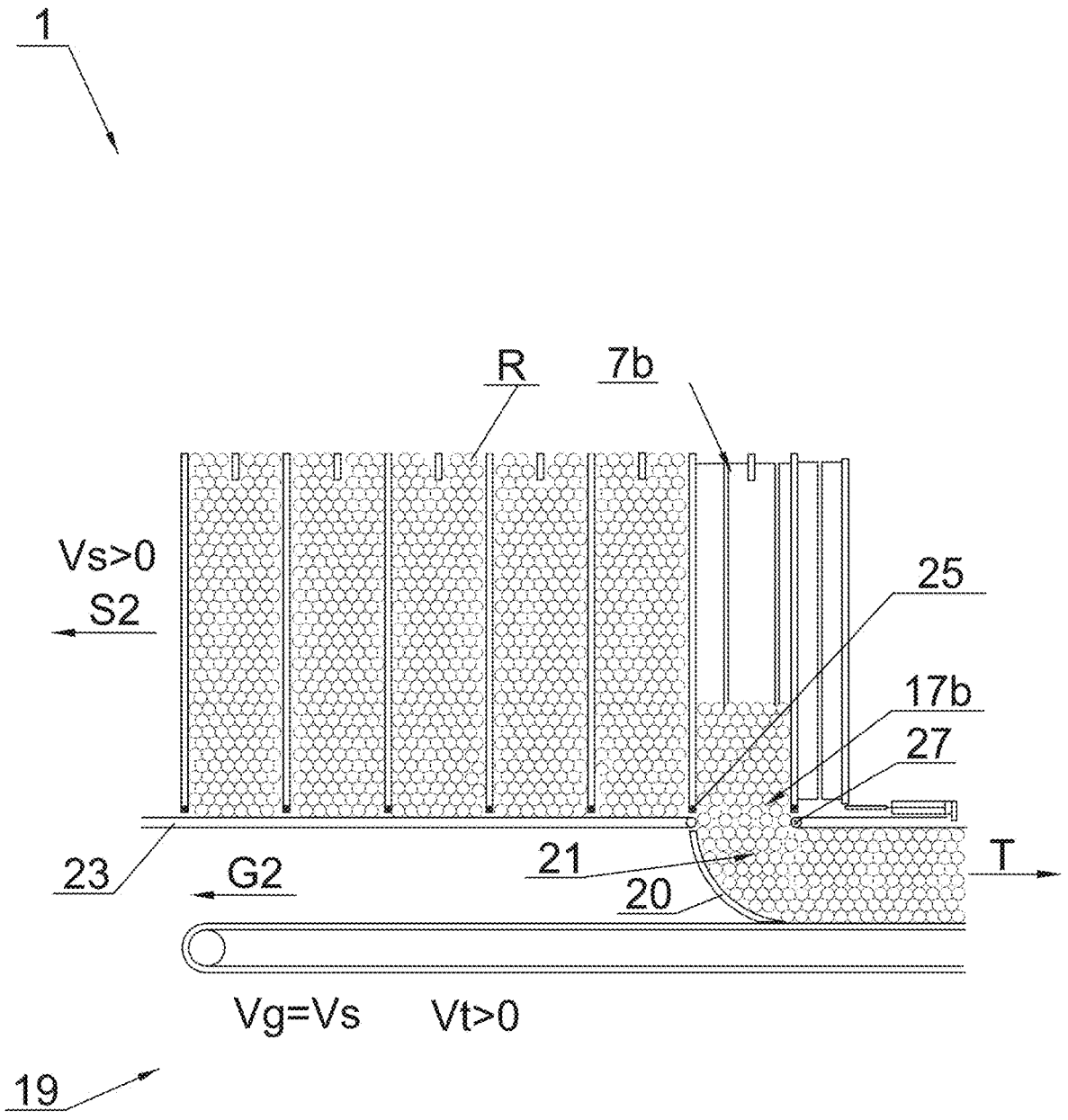

FIG. 8 presents a front view of the station for emptying the filled tray at the moment when the next channel of the hopper is being emptied.

Figure 9:
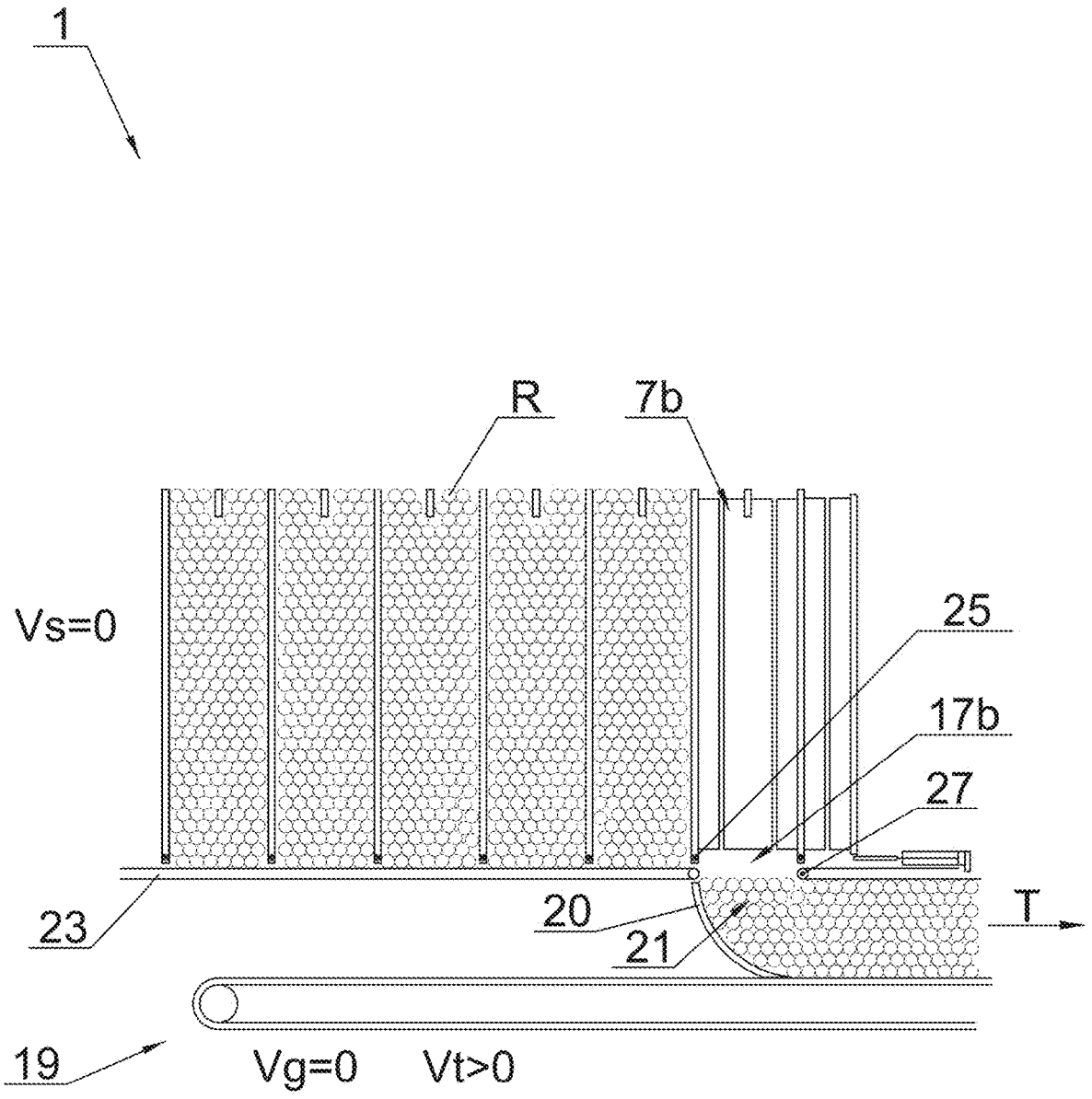

FIG. 9 presents a front view of the station for emptying the filled tray at the moment when the next filled channel of the hopper has been emptied, and the hopper and chute have momentarily stopped to change the direction of movement.

Figure 10:
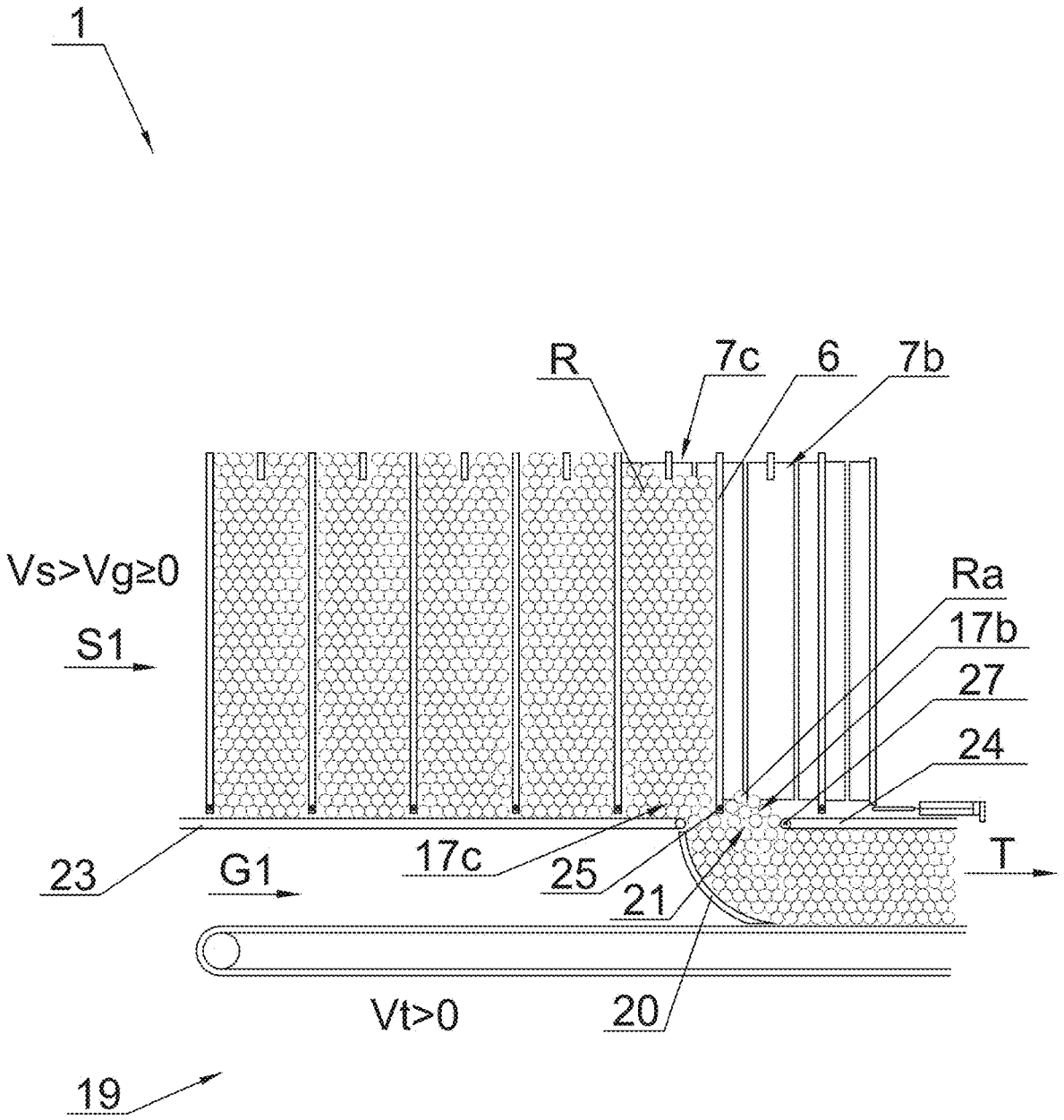

FIG. 10 presents a front view of the station for emptying the filled tray at the moment when the channel of the hopper is being emptied, and both the hopper and the chute with accumulated rod-shaped articles are moving to adjust positions.

Figure 11:
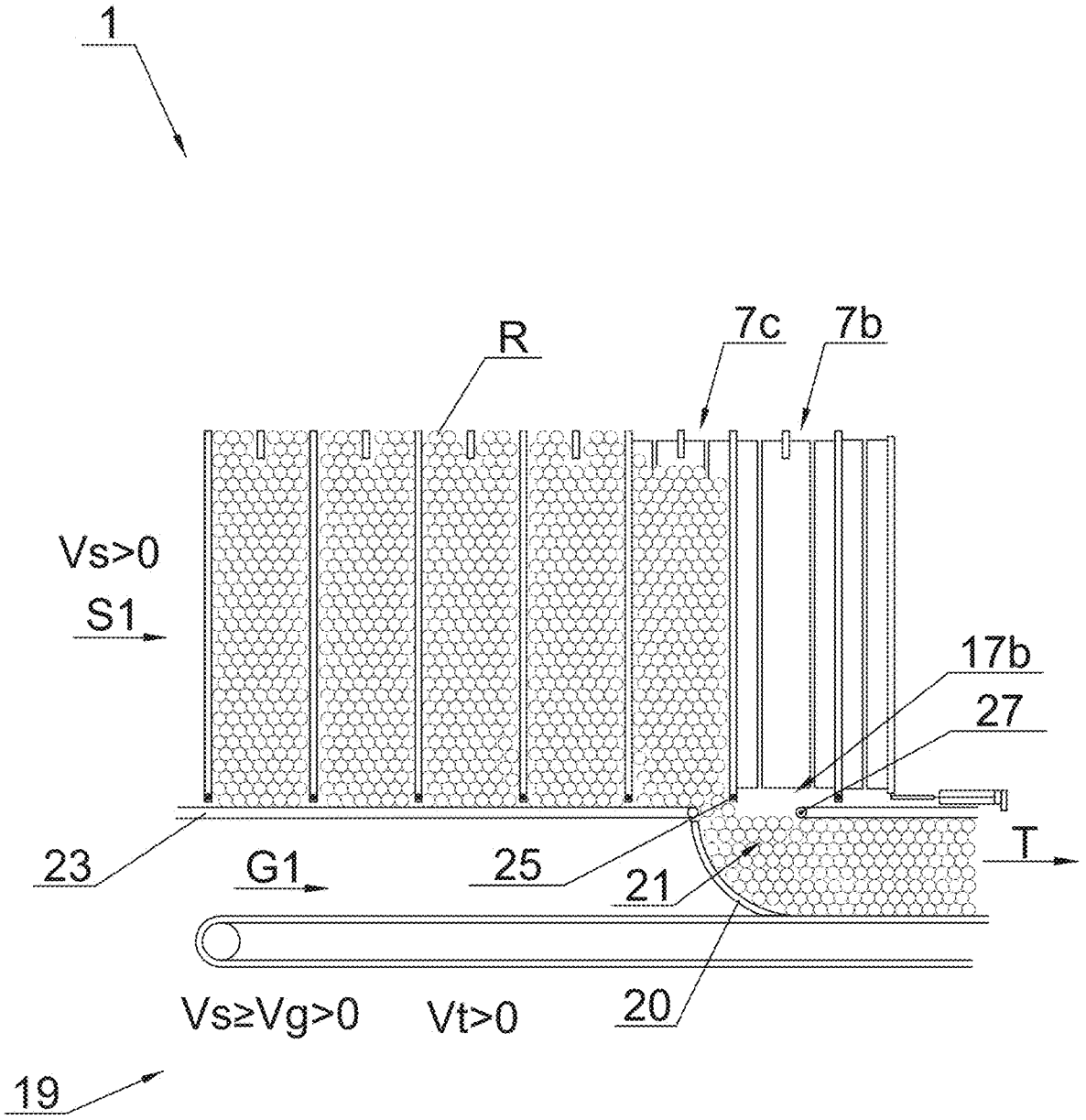

FIG. 11 presents a front view of the station for emptying the filled tray at the moment when the channel of the hopper is being emptied, and both the hopper and the chute without accumulated rod-shaped articles are moving to adjust positions.

Figure 12:
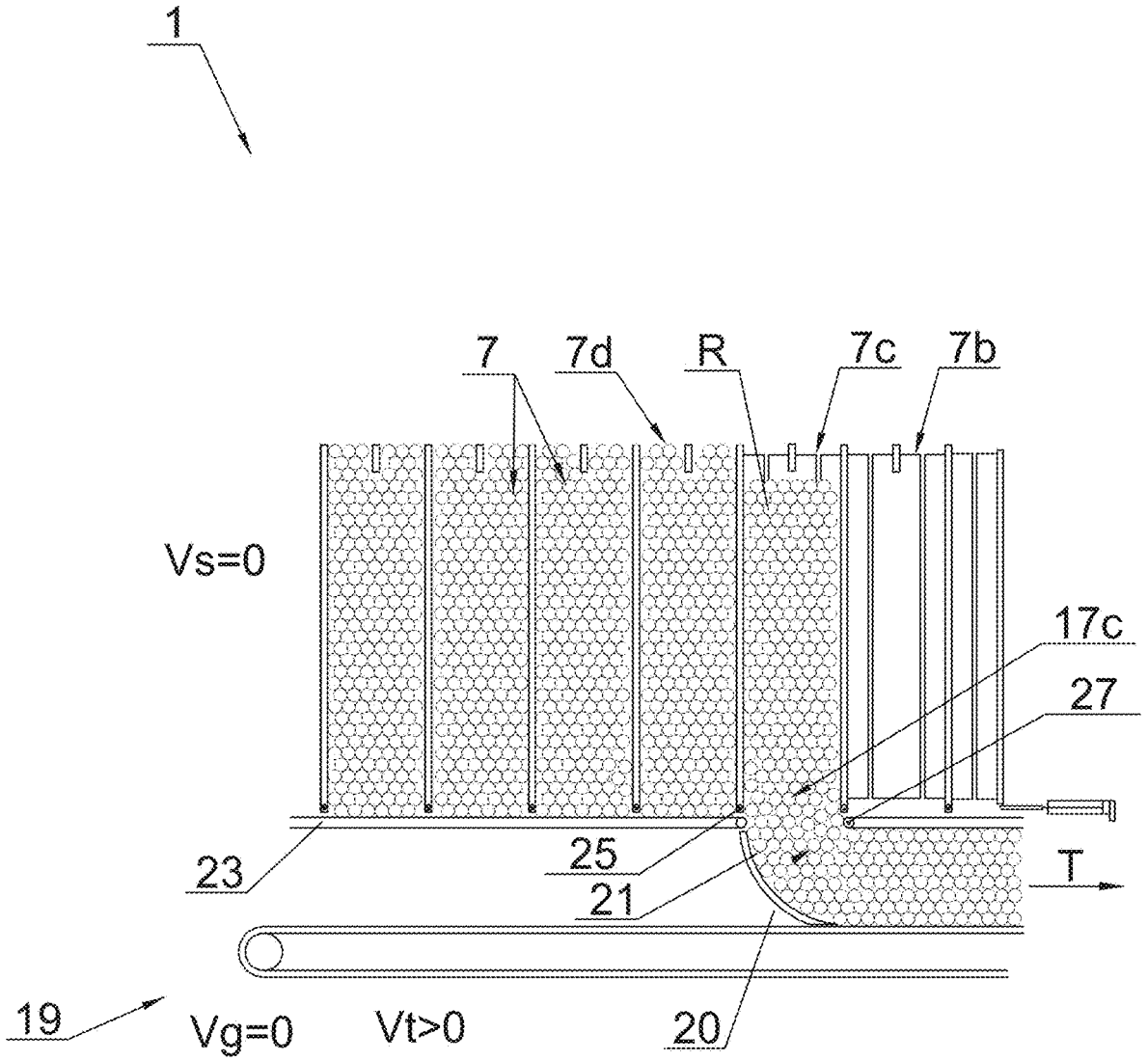

FIG. 12 presents a front view of the station for emptying the filled tray at the moment when the next filled channel of the hopper is aligned with the entrance to the passage.

Figure 13:
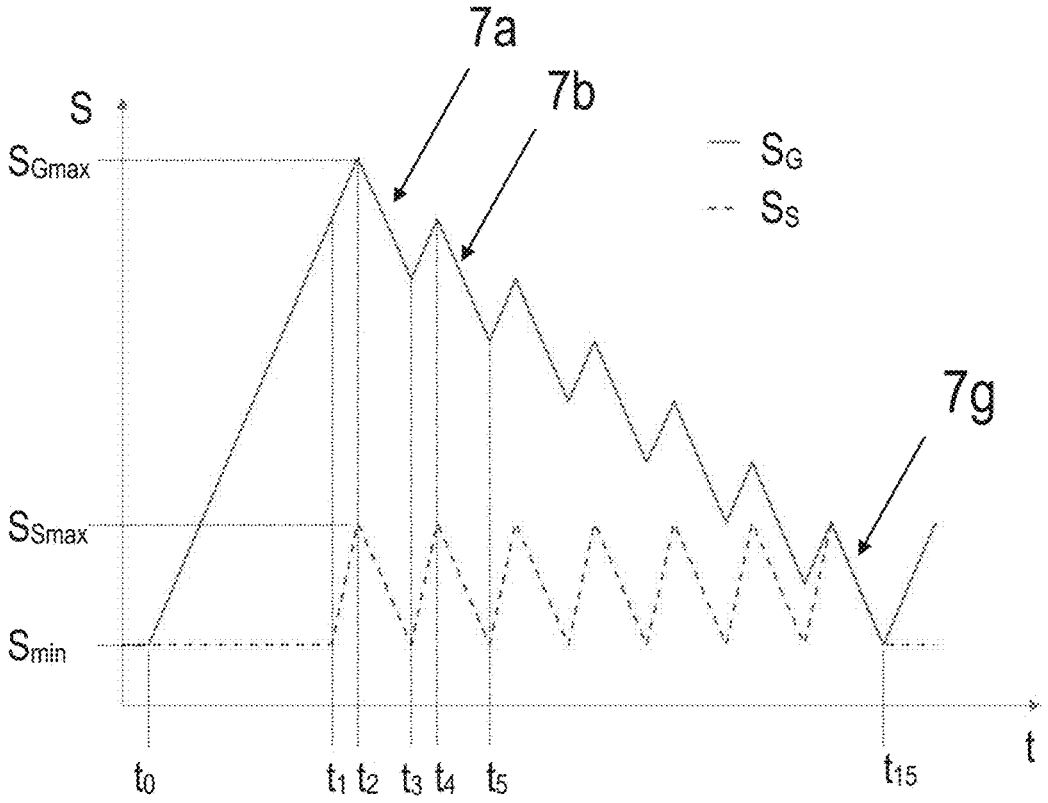

FIG. 13 presents a graph of the changes in position of the chute and the hopper throughout the full emptying cycle of the hopper.

Figure 14:
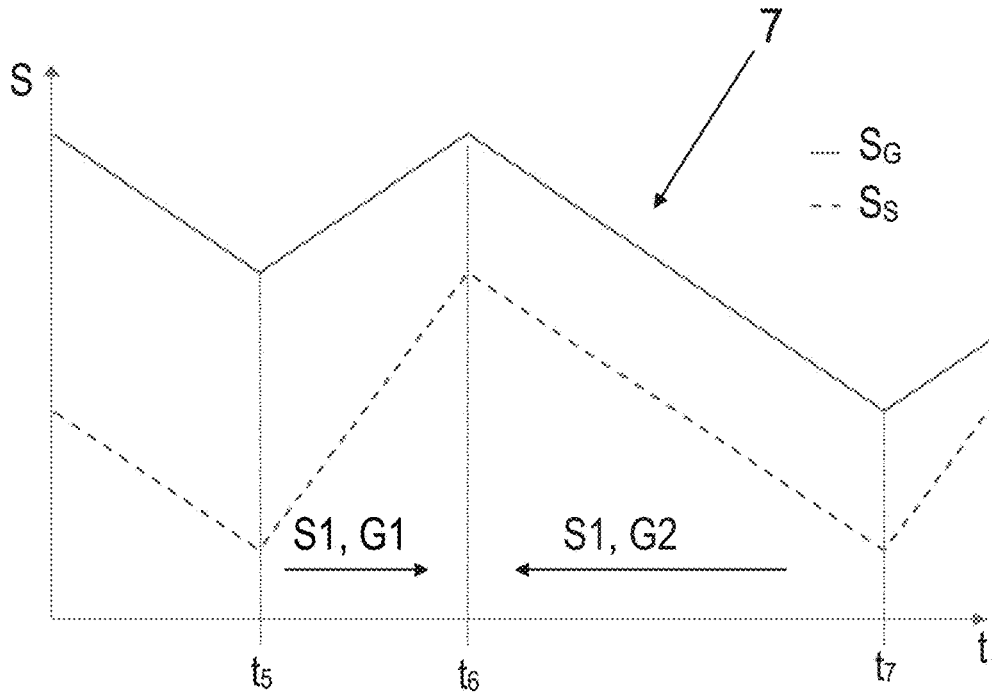

FIG. 14 presents a graph of the changes in position of the chute and the hopper throughout part of the emptying cycle encompassing emptying of one channel.

Figure 15A:
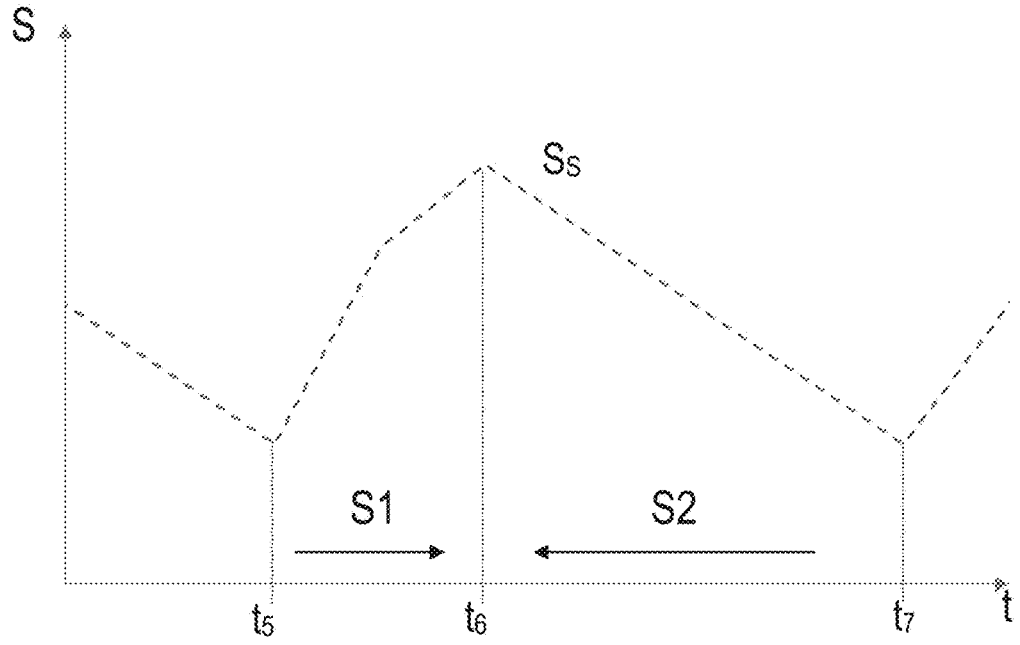

FIG. 15*a* presents a graph of the changes in position of the hopper throughout a part of the emptying cycle encompassing emptying of one channel, with a momentary deceleration of the hopper.

Figure 15B:
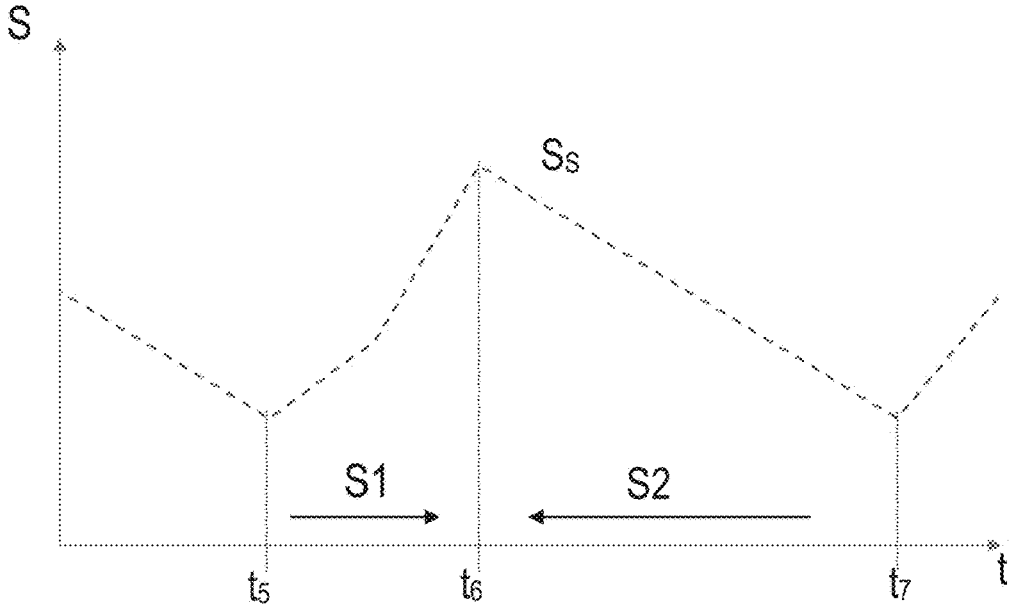

FIG. 15*b* presents a graph of the changes in position of the hopper throughout a part of the emptying cycle encompassing emptying of one channel, with a momentary acceleration of the hopper.

Figure 15C:
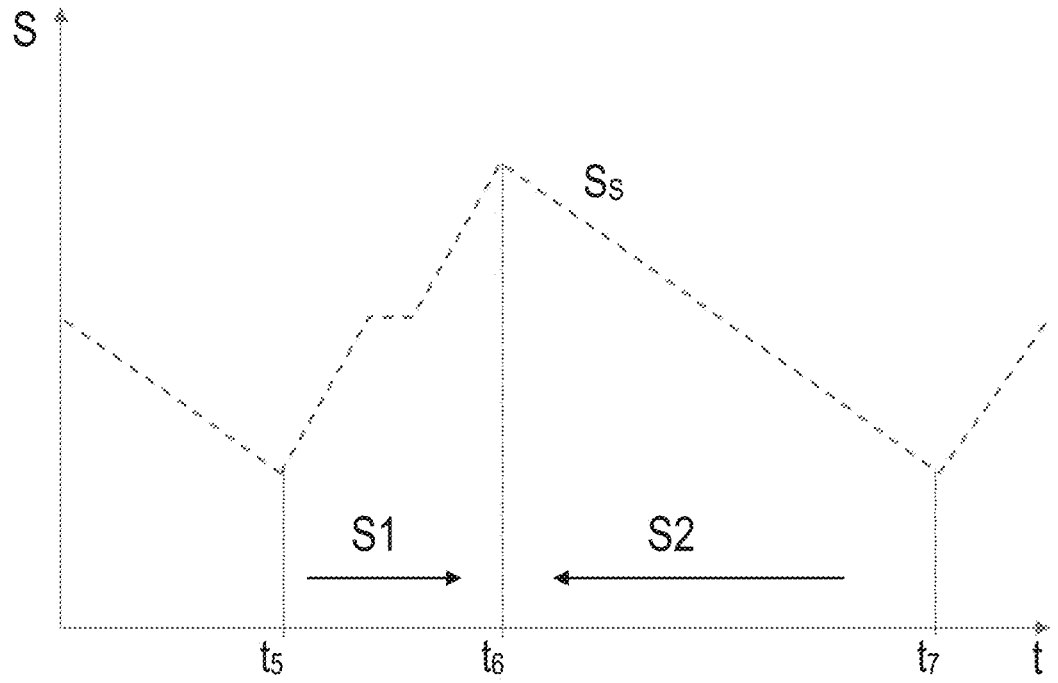

FIG. 15*c* presents a graph of the changes in position of the hopper throughout a part of the emptying cycle encompassing emptying of one channel, with the hopper at a momentary stop.

Figure 15D:
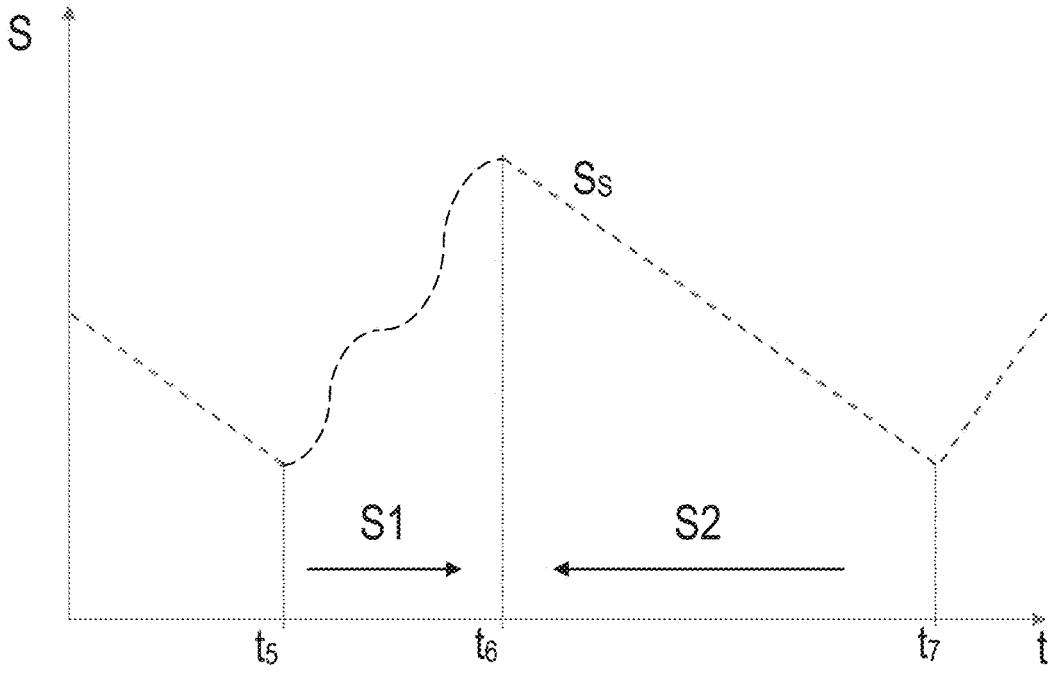

FIG. 15*d* presents a graph of the changes in position of the hopper throughout a part of the emptying cycle encompassing emptying of one channel, with the hopper moving at variable velocity.

For better understanding, the subject of the invention is illustrated in the figures, where FIGS. 1 through 11 present the individual stages of emptying channels and a tray according to the embodiment of the invention, with continuous movement of a discharge conveyor, and FIGS. 12 through 14*c* present the position of the chute and the hopper at the subsequent stages of the cycle for emptying the hopper.

FIG. 1 shows a station 1 for emptying a filled tray. The station 1 has a hopper 2, a discharge conveyor 19, and a chute 20. The hopper 2 has a left side wall 3, a right side wall 4, a rear wall 5, and dividers 6 that divide the space of the hopper 2 into vertical channels 7. The channels 7 may be of equal or different width. FIG. 1 depicts two specific channels 7: an outer channel 7*a*; and a channel 7*g*, which is emptied as the last one. In the embodiment, the outer channel 7*a* is half as wide as the remaining channels 7. The hopper 2 also has a transfer element 8 mounted slideable relative to the dividers of the hopper 2, and which is provided to move the mass flow of rod-shaped articles in the individual channels of the hopper 2 downwards. The transfer element 8 has many support plates 9 which are adapted to support the mass flow of rod-shaped articles through the channels 7 and through the outer channel 7*a*, where each channel 7 has two support plates 9. The support plates 9 are situated horizontally and perpendicular to the rear wall 5 of the hopper 2. The support plates 9 are mounted to supports that pass through slits 11 in the rear wall 5 of the hopper 2, as well as to a supporting element 12 that slides horizontally on a track 13 in the direction perpendicular to the rear wall 5 of the hopper 2. The support plates 9 of the transfer element 8 may be inserted into the channels 7 through the upper notches 14 near the inlets 15 of the channels. The support plates 9 of the transfer element 8 may be retracted from the channels 7 through the lower notches 16 near the outlets 17 of the channels. In the inlets 15 are additional dividers 18 situated at the mid-width of the channels 7.

Below the hopper 2 is a discharge conveyor 19. Between the hopper 2 and the discharge conveyor is a sliding chute 20 adapted to move along the discharge conveyor. The sliding chute 20 is provided to move the mass flow of rod-shaped articles from the channels 7 to the discharge conveyor 19, which discharges the rod-shaped articles received from the channels 7 of the hopper 2 in direction T, where the chute 20 has a separate drive and is adapted to move relative to the discharge conveyor 19. Above the inlet 21 to the chute 20 is a passage 22, which is formed by belts 23, 24.

FIG. 2 presents the station 1 for emptying the filled tray just after the filled tray 10 has been placed thereon, where the sliding cover 28, which is part of the element for transporting the tray, and which keeps the rod-shaped articles R in the tray 10, has not yet been retracted. Channel 7*g* is still partially filled. The tray 10 waits in this position until all the channels 7 are at least partially emptied. After the sliding cover 28 has been retracted, the rod-shaped articles R stored in the tray 10 fall onto the support plates 9 of the transfer element 8. After the rod-shaped articles R have fallen out, the transfer element 8 begins moving downward, so that the rod-shaped articles R are led into the channels 7, as shown in FIG. 3.

The tray 10 can be made of plastic or cardboard, and can be either four- or five-walled. The tray may also be made of other suitable material. Five-walled cardboard trays are usually less solid than four-walled trays, and usually intended for single use.

FIGS. 3 and 4 present the subsequent steps of the process, in which all the rod-shaped articles R from channel 7*g* are passed into the chute 20 through the passage 22, and the absence of rod-shaped articles R in the passage 22 is detected by the accumulation sensor 27. It is also possible to use the signal from one sensor to determine the extent to which the channel is filled with rod-shaped articles, as well as the accumulation of rod-shaped articles in the passage 22. The signal of the absence of rod-shaped articles in the passage 22 is the signal for the chute 20 to move in the direction G1 concurrent with the direction T in which the rod-shaped articles R are transported by the discharge conveyor 19, where the velocity Vt with which the mass flow is conveyed on the conveyor and the velocity Vg of the movement of the chute are equal. This velocity Vg of movement of the chute 20 ensures constant level of the rod-shaped articles in the inlet 21 while the chute 20 is in motion.

Once the inlet 21 of the chute 20 is under the outlet 17*a* of the outer channel 7*a* (FIG. 5), the outer support plate 9*a* is displaced by the actuator 26 in the direction T concurrent with the direction in which the rod-shaped articles R are transported by the discharge conveyor, after which the rod-shaped articles R from the channel 7*a* begin to flow through the passage 22, and join the mass flow on the discharge conveyor 19, which moves with the velocity Vt. When the rod-shaped articles R are being moved from the outer channel 7*a*, the support plates 9 of the transfer element 8 are released in a direction perpendicular to that T of discharge. After the support plates 9 have been retracted, the rod-shaped articles R in the channels 7 rest on the belt 23 or other supporting element (FIG. 6). After all the rod-shaped articles R have been moved from channel 7*a*, which is detected by the channel fill sensor 25, the chute 20 moves with a velocity of Vg, which is equal to the velocity of the conveyor Vt, in direction G1, and the hopper, with linear velocity Vs, which is higher than the velocity of the movement of the chute Vg, moves in direction S1 for faster alignment of the inlet 21 of the chute 20 with the outlet 17*b* of channel 7*b*. (FIG. 7). After the alignment of the inlet 21 of the chute 20 with the outlet 17*b* of channel 7*b*, the hopper 2 and the chute 20 stop for a moment to change the direction of movement, as shown in FIG. 7. Then, the hopper 2 moves in the direction S2 with the velocity Vs, and the chute 20 moves with it at the same velocity in direction G2, which is parallel to S2, where the outlet 17*b* and inlet 21 are at a fixed position relative to each other (FIG. 8). After the channel fill sensor 25 sends a signal indicating that channel 7*b* has been completely emptied of rod-shaped articles R, the hopper 2 and chute 20 momentarily cease movement in order to change the direction of the movement (FIG. 9). FIG. 10 presents the movement of the hopper 2 in the direction S1 in order to align the outlet 17*c* of a channel 7*c* with the inlet 21 of the chute 20, which also moves in the direction G1 with the velocity Vg. The hopper 2 moves at a velocity Vs higher than that of Vg with which the chute 20 moves. When aligning the outlet 17*c* of the channel 7*c* with the inlet 21 of the chute 20 and at the simultaneous opening via the belt 23 of channel 7*b*, the rod-shaped articles Ra may accumulate at the outlet of channel 17*b* and the inlet 21 of the chute 20, and be clipped by the divider 6 of the moving hopper 2 and the belt 24. The accumulation of rod-shaped articles Ra may be caused by the force exerted by the mass of rod-shaped articles R in channel 7*c*, or by the elasticity of the material from which the rod-shaped articles R are made. At the opening of the outlet 17*c* of channel 7*c* via the belt 23, the rod-shaped articles that fall first may bounce off of the rod-shaped articles already in the chute 20 and cause accumulation near the inlet 21. Upon detection of such accumulation of rod-shaped articles Ra by the accumulation sensor 27, the movement of the hopper 2 and/or the chute 20 will be momentarily halted and/or slowed, while the discharge conveyor 19 continues to operate. Momentary halting or deceleration of the hopper 2 and/or the chute 20 will allow the rod-shaped articles Ra near the outlet 17*b* to be removed by the discharge conveyor 19. After receiving a signal from the accumulation sensor 27 that the rod-shaped articles Ra have been removed from the outlet of channel 17*b* by the discharge conveyor 19, the hopper 2 will continue moving in the direction S1 with velocity Vs, together with the chute the 20, which will move parallel in direction G1 with velocity Vg, as shown in FIG. 11. Also possible is an embodiment in which, during each movement of the hopper 2 in direction S1 and the chute 20 in direction G1 in order to align the inlet 21 of the chute 20 with the outlet 17 of channel 7, momentary halting or deceleration of the hopper 2 and/or the chute 20 is forced by a propulsion program of the emptying station 1, without the intervention of an accumulation sensor 27. Upon alignment of the outlet 17*c* of channel 7*c* with the inlet 21 of the chute 20 (FIG. 12), the hopper 2 and chute 20 are momentarily halted in order to change the direction of movement, at which point the rod-shaped articles R are emptied from channel 7*c*.

The other channels 7 of the hopper 2 are emptied in the same way.

When aligning the next channel 7*c* with the chute 20, the hopper 2 can make a movement of various parameters depending on the nature of the accumulation, the properties of the rod-shaped articles, the operating velocities of the trays used in the system, and other similar parameters in the process of emptying and transporting the rod-shaped articles. It is also possible to apply a non-linear change in the motion of the hopper 2, whose instantaneous velocity can increase or decrease at certain points. The instantaneous velocity of the hopper 2 can change stepwise or continuously. The hopper 2 can also move in reverse, with multiple changes in the direction of motion. Furthermore, it is possible to adjust the acceleration so as to improve the accumulation of rod-shaped articles inside the channels 7 of the hopper 2.

It should be noted here that the nature of the movement of the hopper 2, as determined by its parameters, such as instantaneous velocity, acceleration, and velocity-change points, can change over time. The parameters can also be set to apply only for a single operation cycle. In case of changes in motion parameters, it is possible to use presets, as well as apply adaptive changes over time, for example in response to changes in the velocity of the discharge conveyor 19.

The shift in location of the chute 20 and the hopper 2 throughout the entire cycle of emptying of the hopper 2 is presented in FIG. 13. The solid line shows the path $S_G$ traversed by the chute 20 as a function of time t, while the dashed line $S_s$ shows the path traversed by the hopper 2 as a function of time t. In the time interval from $t_0$ to $t_2$, the chute 20 performs a reverse motion in the direction G1 of the starting position $S_{Gmax}$, from the last channel 7*g* back to the first 7*a*. Simultaneously, in the time interval from $t_0$ to $t_1$, the rod-shaped articles are emptied from the tray 10 to the channels 7 of the hopper 2; and in the time interval from $t_1$ to $t_2$, the hopper 2 moves to the starting position indicated on the graph $S_{Smax}$. In the time interval from $t_2$ to $t_3$, channel 7*a* of the hopper 2 is emptied, while both the chute 20 and hopper 2 simultaneously move with the same velocity in direction G2, until channel 7*a* has been completely emptied of rod-shaped articles. At point $t_3$, the hopper 2 and the chute 20 momentarily come to a halt, and begin reverse motion in direction G1, until the next outlet 17*b* of filled channel 7*b* of the hopper 2 is aligned with the inlet 21 of the chute 20, which is indicated on the graph by $t_4$. At point $t_4$, the chute 20 and the hopper 2 momentarily come to a halt, and change their direction of movement from G1 to G2. Then, in the time interval from $t_4$ to $t_5$, channel 7*b* of the hopper 2 is emptied, while both the chute 20 and hopper 2 simultaneously move with the same velocity in direction G2, until channel 7*b* has been completely emptied of rod-shaped articles. This cycle of movement of the hopper 2 and the chute 20 repeats until all rod-shaped articles R have been emptied from the last channel 7*g* of the hopper 2 at $t_{15}$. FIG. 14 shows a graph of the changes in position of the chute 20 and the hopper 2 throughout part of the emptying cycle including emptying of one channel. In the time between $t_5$, and $t_6$, the chute 20 and hopper 2 move in directions S1 and G1 in order to align the filled channel 7*c* of the hopper 2 with the inlet 21 of the chute 20. At this stage, the velocity of the chute 20 is adapted to the velocity at which the rod-shaped articles R are transported by the discharge conveyor; and the distance traversed by the hopper 2 is therefore increased by the distance traversed by the chute 20. This means that the instantaneous velocity of the hopper 2 is higher than the velocity of the chute 20 from $t_5$ to $t_6$. At point $t_6$, the directions of the chute 20 and hopper 2 change to S2 and G2. In the time interval from $t_6$ to $t_7$, the rod-shaped articles R are emptied from channel 7*c*, and the chute 20 and hopper 2 move in directions S2 and G2 at the same velocity until all rod-shaped articles R have been emptied from channel 7*c*.

FIGS. 15*a* to 15*d* present examples of the movement of the hopper in the time interval from $t_5$ to $t_7$. In the time interval from $t_5$ to $t_6$, the velocity of the hopper 2, after being completely emptied, moves in the direction concurrent with that of T in which the rod-shaped articles R are transported by the discharge conveyor 19 until the outlet of the next channel filled with rod-shaped articles is aligned with the inlet 21 of the chute 20 $t_6$. The velocity of movement of the hopper 2 in the direction concurrent with that of S1 in which the rod-shaped articles R are transported by the discharge conveyor 19 changes over time. The variable movement of the hopper 2 relative to the chute 20 is intended to eliminate damage to the rod-shaped articles Ra which may occur due to clipping of the rod-shaped articles Ra by the divider 6 of the moving hopper 2 or the belt 24. Examples of changes in the movement of the hopper 2 relative to the chute 20 are presented in FIG. 15*a*-15*d*, where the velocity of the hopper decreases stepwise in FIG. 15*a*, increases stepwise in FIG. 15*b*, momentarily decreases to zero in FIG. 15*c*, and changes continuously over time in FIG. 15*d*.

LIST OF TERMS

1 station for emptying filled tray
2 hopper
3 left side wall of hopper
4 right side wall of hopper
5 rear wall of hopper
6 dividers
7 channels of hopper
7*a* outer channel
7*b* channel of hopper
8 transfer element
9 support plates
9*a* outer support plate
10 tray
11 vertical slits
12 support element
13 track
14 upper notches
15 channel inlets
16 lower notches
17 channel outlets
17*a*-17*g* channel outlets
18 additional dividers
19 discharge conveyor
20 sliding chute
21 chute inlet
22 passage
23 belt
24 belt
25 channel fill sensor
26 actuator
27 accumulation sensor
28 sliding cover
Ra accumulated articles
R rod-shaped articles
$S_G$ path of chute
$S_S$ path of hopper
Vs velocity of hopper
Vt velocity of discharge conveyor
Vg velocity of chute

The invention claimed is:

1. A method of emptying trays filled with rod-shaped articles of a tobacco industry, the method comprising the following steps:

conveying trays designated for emptying to an input area of a hopper containing adjacent channels separated by dividers;

transferring rod-shaped articles from the trays to the channels of the hopper using support plates;

filling the channels of the hopper with the rod-shaped articles;

retracting the support plates from the channels of the hopper;

emptying successively the channels of the hopper into a chute adapted to move between channel outlets of the hopper;

transferring the rod-shaped articles from the channels of the hopper and through the chute onto a discharge conveyor moving towards a receiving device;

characterized in that during emptying at least one channel (7) of the hopper (2), the hopper (2) moves linearly in a direction (S2) opposite to a direction (T) in which the rod-shaped articles are transported by the discharge conveyor (19); and after the channel (7) has been completely emptied, the hopper (2) moves in the direction (S1) concurrent with the direction (T) in which the rod-shaped articles are transported by the discharge conveyor (19), until the hopper (2) achieves a position in which the outlet of a next channel (7) filled with rod-shaped articles (R) is aligned with an inlet (21) of the chute (20), whereas the hopper (2) moves at a variable velocity while moving in the direction (S1) concurrent with the direction (T) in which the rod-shaped articles are transported by the discharge conveyor, and the chute (20), in order to empty the rod-shaped articles from at least one channel (7) of the hopper (2), moves linearly in the direction (G2) opposite to the direction (T) in which the rod-shaped articles are transported by the discharge conveyor (19), until all the rod-shaped articles (R) have been emptied from the channel (7), further characterized in that while the hopper (2) is moving in the direction (S1) concurrent with the direction (T) in which the rod-shaped articles are transported by the discharge conveyor (19), the hopper (2) moves at a first velocity, and as a result of receiving a signal from an accumulation sensor (27) that rod-shaped articles have accumulated near the inlet (21) of the chute (20), the hopper (2) moves at at least one second velocity, whereas the second velocity is lower than the first velocity, before the hopper (2) achieves a position in which the outlet of the next channel filled with rod-shaped articles (R) is aligned with the inlet (21) of the chute (20).

2. The method according to claim 1, characterized in that after the hopper (2) has moved in a direction (S1) concurrent with a direction (T) in which the rod-shaped articles (R) are transported by the discharge conveyor (19), the velocity of the hopper (2) reaches zero.

3. The method according to claim 1, characterized in that while the hopper (2) is moving in the direction (S1) concurrent with the direction (T) in which the rod-shaped articles are transported by the discharge conveyor (19), the velocity of the hopper (2) decreases until the hopper (2) achieves a position in which the outlet of the next channel filled with rod-shaped articles (R) is aligned with the inlet (21) of the chute (20).

4. The method according to claim 1, characterized in that the direction of movement of the hopper (2) changes as a result of receiving a signal from a channel fill sensor (25) indicating a change in an extent to which the hopper is filled with rod-shaped articles, from the direction opposite to the direction in which the rod-shaped articles are transported by the discharge conveyor (19), to the direction concurrent with the direction in which the rod-shaped articles are transported by the discharge conveyor.

5. The method according to claim 1, characterized in that the direction of movement of the hopper (2) changes as a result of receiving a signal from the channel fill sensor (25) indicating alignment of the next filled channel (7) of the hopper (2) with the inlet (21) of the chute (20), from the direction concurrent with the direction in which the rod-shaped articles are transported by the discharge conveyor (19), to the direction opposite to the direction (T) in which the rod-shaped articles are transported by the discharge conveyor (19).

6. The method according to claim 5, characterized in that the chute (20) moves linearly in a direction (G2) opposite to the direction (T) in which the rod-shaped articles are transported by the discharge conveyor (19) at an instantaneous velocity equal to the velocity of movement of the hopper (2).

7. The method according to claim 1, characterized in that the chute (20), as a result of receiving a signal from the channel fill sensor (25) indicating that the rod-shaped articles have been emptied from the channel (7) of the hopper (2), starts to move linearly in a direction (G1) concurrent with the direction (T) in which the rod-shaped articles are transported by the discharge conveyor (19), until the next filled channel (7) of the hopper (2) is aligned with the inlet (21) of the chute (20).

8. The method according to claim 7, characterized in that the chute (20) moves in the direction (G1) concurrent with the direction (T) in which the rod-shaped articles are transported by the discharge conveyor (19) at an instantaneous velocity lower than the velocity of movement of the hopper (2).

9. The method according to claim 7, characterized in that the chute (20) moves in the direction (G1) concurrent with the direction (T) in which the rod-shaped articles are transported by the discharge conveyor (19) with a velocity equal to the velocity at which the rod-shaped articles are transported by the discharge conveyor (19).

* * * * *